US005297632A

United States Patent [19]

Blandford

[11] Patent Number: 5,297,632

[45] **Date of Patent: * Mar. 29, 1994**

[54] METHOD AND APPARATUS FOR PRODUCTION OF SUBSEA HYDROCARBON FORMATIONS

[76] Inventor: Joseph W. Blandford, 15 Mott La., Houston, Tex. 77024

[ * ] Notice: The portion of the term of this patent subsequent to Jun. 2, 2009 has been disclaimed.

[21] Appl. No.: 891,953

[22] Filed: Jun. 1, 1992

Related U.S. Application Data

[63] Continuation of Ser. No. 626,994, Dec. 13, 1990, Pat. No. 5,117,914.

[51] Int. Cl.[5] ..... B63B 35/44

[52] U.S. Cl. ..... 166/344; 166/352; 166/354

[58] Field of Search ..... 166/341, 342, 343, 344, 166/345, 352, 353, 354, 366

[56] References Cited

U.S. PATENT DOCUMENTS

| | | | |
|---|---|---|---|
| 3,401,746 | 9/1968 | Stevens et al. | 166/352 |
| 3,982,401 | 9/1976 | Loggins | 166/352 X |
| 4,727,819 | 3/1988 | Pollack | 166/354 X |
| 4,754,817 | 7/1988 | Goldsmith | 166/353 X |

*Primary Examiner*—William P. Neuder
*Attorney, Agent, or Firm*—Gunn & Kuffner

[57] ABSTRACT

A well tender system for controlling, separating, storing and offloading well fluids produced from subsea hydrocarbon formations. The system comprises a vertically aligned series of tethered cylindrical tanks which are torsionally stabilized by flexible catenary production riser and export riser bundles, and serviced by separate catenary pipe bundles. Piles are secured to the seabed, each pile assembly being pivotally connected to a lower rigid tendon, which is in turn connected to tendons arranged about the periphery of the interconnected cylindrical tanks.

5 Claims, 14 Drawing Sheets

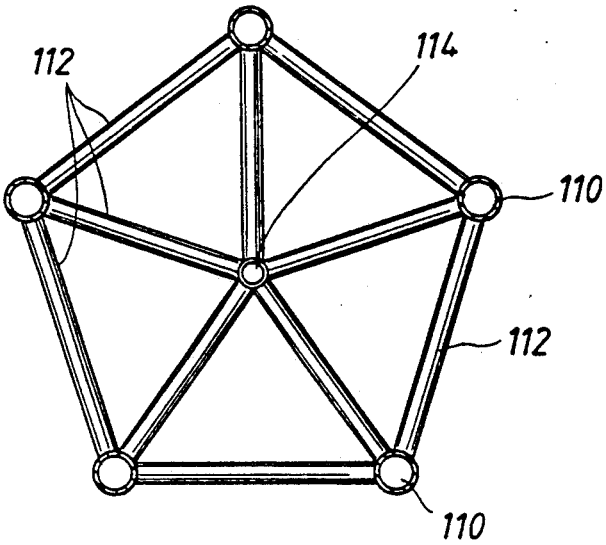
FIG.14C
FIG.14A
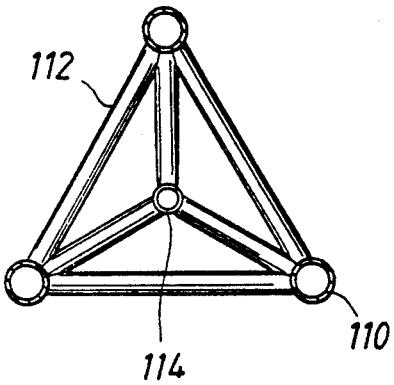
FIG.14D
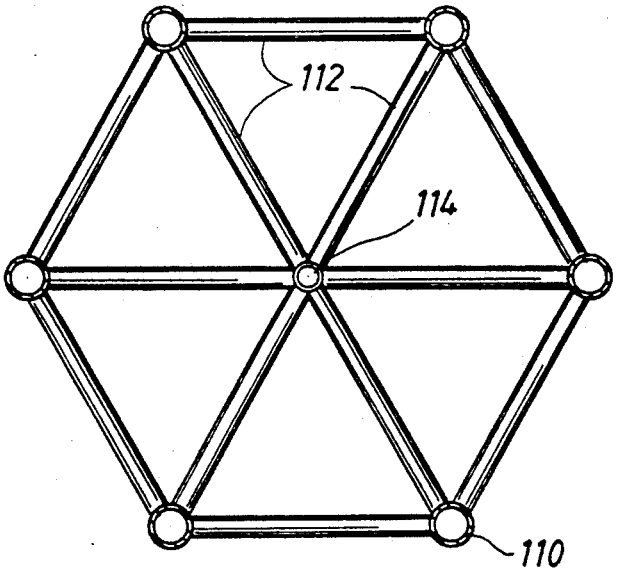
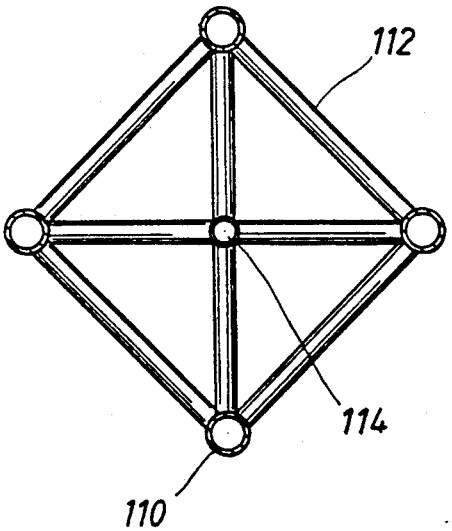
FIG.14B

METHOD AND APPARATUS FOR PRODUCTION OF SUBSEA HYDROCARBON FORMATIONS

This is a continuation of application Ser. No. 07/626,994 filed Dec. 13, 1990, U.S. Pat. No. 5,117,914, issued Jun. 2, 1992.

BACKGROUND OF THE DISCLOSURE

The present invention is directed to a method and apparatus for testing and producing hydrocarbon formations found in deep (over 300 feet) offshore waters, particularly to a method and deepwater system for economically producing relatively small deep water hydrocarbon reserves which currently are not economical to produce utilizing conventional technology.

Commercial exploration for oil and gas deposits in U.S. domestic waters, principally the Gulf of Mexico, is moving to significantly deeper waters (over 300 feet) as shallow water reserves are being depleted. Deep water exploration is usually undertaken only by major oil companies, due to its very high cost. The major oil companies must discover very large oil and gas fields with large reserves to justify the large capital expenditure needed to establish commercial production. The value of these reserves is further discounted by the long time required to begin production using current technology. As a result, many smaller or "lower tier" offshore fields are deemed to be uneconomical to produce. The economics of these deepwater small fields can be significantly enhanced by improving and lowering the cost of methods and apparatus to produce hydrocarbons from them.

In water depths up to about 300 feet, in regions where other oil and gas production operations have been established, successful exploration wells drilled by jack-up drilling units are routinely completed and produced. Such completion is often economically attractive because bottom founded structures can be installed to support the surface-piercing conductor pipe left by the jack-up drilling unit. Moreover, in a region where production operations have already been established, available pipeline capacities are relatively close, making pipeline hook-ups economically viable.

Significant hydrocarbon discoveries in water depths over about 300 feet are typically exploited by means of centralized drilling and production operations that achieve economies of scale. These central facilities are costly and typically require one to five years to plan and construct. To economically justify such central facilities, sufficient producible reserves must be proven prior to committing to construction of a central facility. Depending on geological complexity, the presence of commercially exploitable reserves in water depths of 300 feet or more is verified by a program of drilling and testing a number of expendable exploration and delineation wells, typically 4 to 12 wells. The total period of time from drilling a successful exploration well to first production from the central drilling and producing platform typically ranges from two to ten years.

A complete definition of the reservoir and its producing characteristics is not available until the reservoir is produced for an extended period of time, typically one or more years. However, it is necessary to design and construct the producing facility several years before the producing characteristics of the reservoir are precisely defined. This often results in facilities with either excess or insufficient allowance for the number of wells required to efficiently produce the reservoir and excess or insufficient plant capacity at an offshore location where modifications are costly.

Early production and testing systems have been used in the past by converting Mobil Offshore Drilling Units ("MODU's"). A drilling unit is overkill for early production of less prolific wells and when the market tightens, such conversions may not be economical. Similarly, converted tanker early production systems, heretofore used because they were plentiful and cheap, can also be uneconomic for less prolific wells. The system of the present disclosure efficiently and economically supports a production operation, whereas a MODU is intended for drilling and a tanker system for transportation of hydrocarbons.

As noted in U.S. Pat. No. 4,556,340 (Morton), floating hydrocarbon production facilities have been utilized for development of marginally economic discoveries, early production and extended reservoir testing. Floating hydrocarbon production facilities also offer the advantage of being easily moved to another field for additional production work and may be used to obtain early production prior to construction of permanent, bottom founded structures. Floating production facilities have heretofore been used to produce marginal subsea reservoirs which could not otherwise be economically produced. In the aforementioned U.S. Pat. No. 4,556,340, production from a subsea wellhead to a floating production facility is realized by the use of a substantially neutrally buoyant flexible production riser which includes biasing means for shaping the riser in an oriented broad arc. The broad arc configuration permits the use of wire line well service tools through the riser system.

In U.S. Pat. No. 4,784,529 (Hunter) a mooring apparatus and method for securely mooring a floating tension leg platform to an anchoring base template is disclosed. The method includes locating a plurality of anchoring means on the sea bed, the anchoring means being adapted for receipt of a mooring through a side entry opening in the anchoring means. A semi-submersible floating structure is stationed above the anchoring means for connection thereto by the mooring tendons.

An FPS (Floating Production System) consists of semisubmersible floater, riser, catenary mooring system, subsea system, export pipelines, and production facilities. Significant system elements of an FPS do not materially reduce in size and cost with a reduction in number of wells or throughput. Consequently, there are limitations on how well an FPS can adapt to the economic constraints imposed by marginal fields or reservoir testing situations. The cost of the semisubmersible vessel (conversion or newbuild) and deepwater mooring system alone would be prohibitive for many of these applications.

Note that the semisubmersible configuration was developed for drilling applications. Here a large amount of payload must be supported with low free-floating motions. In marginal field applications neither requirement is important. In the present invention, only small payloads are required and these can be supported on a small deck which can be supported by a centrally located single surface-piercing column, rather than four corner located surface-piercing columns. Low free-floating motions are not required because a permanent vertical tension mooring will restrain vertical motions. As the need for large waterplane area is reduced, the structure in the wave zone can become more transparent, reducing environmental load and cost.

A TLP (Tension Leg Platform) consists of a four column semisubmersible floater, multiple vertical tendons on each corner, tendon anchors, and well risers. A single leg TLP has four columns and a single tendon/well. The TLP deck is supported by four columns that pierce the water plane. TLP's typically bring well(s) to the surface for completion.

As the TLP size is reduced, and the distance between corners diminishes, yaw motions increase and lead to interference between well risers. They twist around each other thereby creating a potential safety hazard with well risers. In the case of a single leg TLP, a catenary mooring is required to prevent large twisting displacements. The deepwater catenary mooring is a substantial additional cost element.

There are limitations on the extent to which a TLP can be reduced in size and cost. No matter how small the TLP's payload, it must contain enough buoyancy to keep sufficient pre-tension on tendons so that tendons never go slack as a wave trough passes. A slack tendon can snap to very high tension loads that cause high fatigue damage or overstress.

A further restriction in shrinking a TLP is the fact that during tow and installation, the TLP's stability depends on water plane area. This limits how close together the columns can be spaced. After the TLP's tendons are in place, the tendon tension stabilizes the TLP and it need not be stable in the free floating condition. The system of the present disclosure is designed for a stable tow with only a single column piercing the water plane. A conventional TLP has at least four columns that pass through the water surface and attract environmental load. This is four times as much column wind area and load as the system configuration of the present disclosure.

SUMMARY OF THE INVENTION

In accordance with the method and apparatus of the present invention, a method of producing hydrocarbons in water depths over 300 feet comprises locating a series of cylindrical tanks with or without production vessels below the waterline. The tanks are secured to each other in series and are secured to the seabed by a vertical mooring system. A surface-piercing buoy is atop the series of tanks for supporting processing and control equipment. Flow is conducted from each well by a flexible catenary riser pipe bundle. This catenary riser also provides a restoring torque which aids in stabilizing the vertical mooring system.

A separate service riser bundle extends from the surface buoy through a catenary or floating hose to a pick-up buoy that allows the production system to be serviced and off-loaded by vessels keeping station in a watch circle around the surface buoy. During off-loading, liquids in the underwater pressurized storage tanks flow to tanks maintained at a lower pressure on a shuttle vessel in fluid communication with the pick-up buoy. Liquids can flow directly to the shuttle vessel from topsides when the shuttle is on station and connected. When produced hydrocarbons may be economically injected into a pipeline or in other applications where it is not necessary to store liquids on the platform, no oil storage vessels or separate buoyancy tanks are located subsea.

Alternatively, and depending on the particular application, the method and apparatus of the invention includes securing all production vessels on the deck located above the waterline, leaving only the oil storage tanks and buoyancy tanks in a subsea vertically-oriented position. Liquid storage tanks for receiving, storing and discharging produced liquids may be located at the lowest level of the series of cylindrical tanks. One or more buoyancy tanks are provided above the storage tanks and submerged equipment (if present) to ensure that the entire series is held in a near vertical configuration whether the storage tanks are full or empty, during storm conditions or normal conditions. In this configuration, produced oil and gas is processed by and through the equipment located atop the deck. Oil is separated from the gas and water and pumped to the submerged storage tanks for storage. The water is treated, cleaned to industry code specifications, and dumped overboard. Gas is dehydrated and either injected into a pipeline for sale to a gas buyer, or reinjected into the producing reservoir to maintain pressure, as the situation requires.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIGS. 14–14D are plan views of a 3, 4, 5 and 6 tank configurations of the surface-piercing buoy;

DETAILED DESCRIPTION OF THE INVENTION

The well tendon system of the present disclosure may be adapted for various configurations. Depending on the conditions and facilities at the well site, the system may or may not require oil storage vessels and/or separate buoyancy tanks. The system may also be installed, temporarily or permanently, directly above a well.

Figure 1:
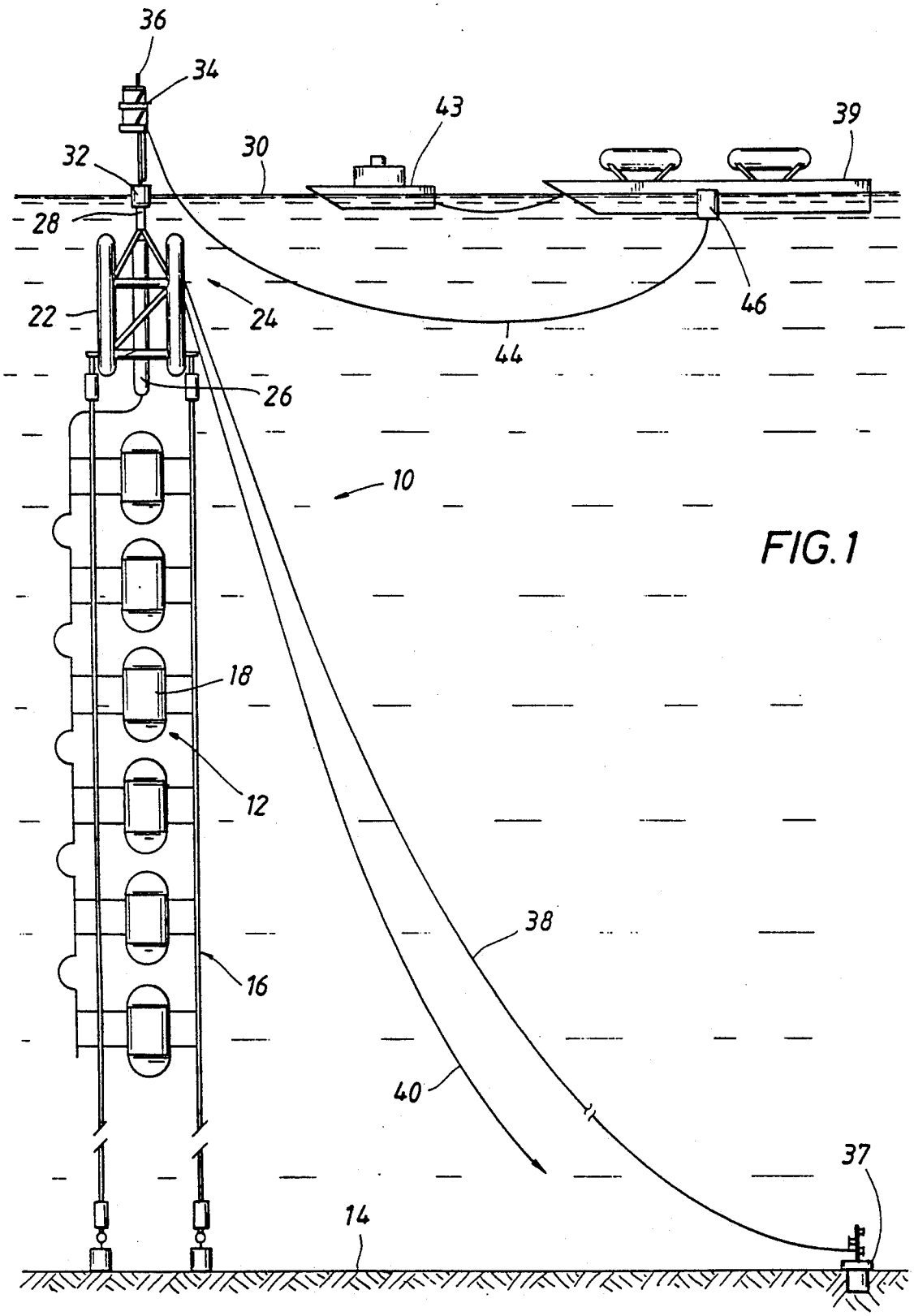
FIG. 1 is an elevational environmental view showing the well tender system of the present disclosure installed at a location offset from subsea well(s)

Referring first to FIG. 1, the well tender system of invention is generally identified by the reference numeral 10. The well tender system 10 comprises a plurality of vertically aligned cylindrical tanks 12 that are secured to the sea bed 14 by a vertical mooring system 16. Liquid storage tanks 18 are located at the lowest level of the aligned series of tanks 12 for receiving well fluids from topsides. The storage tanks 18 store contents under pressure so that well fluids may be off-loaded to a cargo barge or the like without requiring pumps to move the well fluids. If additional buoyancy (beyond surface buoy) is necessary, external buoyancy tanks 22 are provided above storage tanks 18 to ensure that the entire series of tanks 12 are held in a near vertical configuration under all expected conditions.

A surface piercing buoy 24 is located at the top of the vertically aligned series of tanks 12. The surface buoy 24 supports process and flow control equipment. The surface buoy 24, as shown in FIG. 1, includes a stiffened central column tank 26, external buoyancy tanks 22, and transition structure 28 that extends upwardly through the waterline 30. A boat landing 32 is fitted to the column 28 at the waterline 30. The column 28 terminates in a top module or deck 34 which houses the process and control equipment. A vent 36 may extend above the deck 34 for flaring gas which is not exported from the site via a pipeline or the like.

One or more catenary flexible flow line risers conduct fluids from subsea wells 37 to topside process equipment. The catenary risers 38 and export risers 40 which extend radially about the well tender system 10 are available to provide a torsional restoring force to the string of aligned tanks 12. One or more of the catenaries are selected to provide restoring torque and installed with a predetermined amount of pretension. The remaining lines may be installed in a slack catenary. A lever arm connects the catenary risers 38, selected to provide restoring torque, or export risers 40 to the surface buoy 24. The lever arm(s) is placed at an azimuth in the general direction of the lines selected to provide restoring torque. The final lever arm azimuth is set at installation by means of a pivot which is adjusted to the desired orientation and then locked in position. Well fluids are off-loaded to a cargo barge or other facility through an off-loading riser 44 which extends from the top side module 34 to the remote buoy 46. The offloading riser can also be a floating hose configuration or a catenary.

Figure 2:
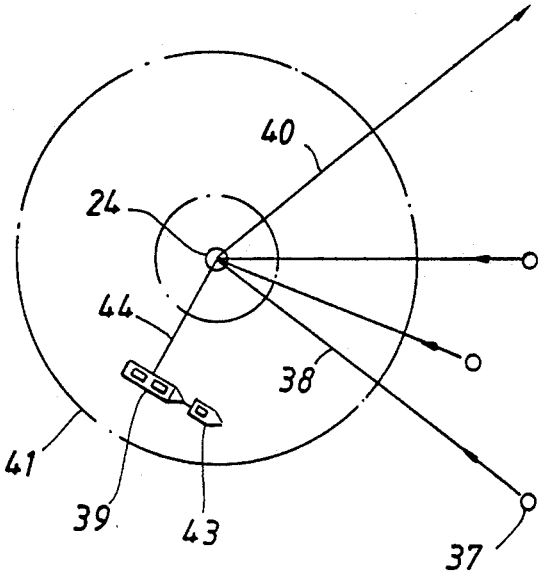
FIG. 2 is a top plan view of the well tender system of the system showing the surface vessel watch circle.

In FIG. 2, recovery of hydrocarbons from multiple wells utilizing the well tender system 10 of the present disclosure is more clearly shown. As can be seen, the flow line risers 38 and export riser 40 extend radially from the well tender system 10 to the wells 37 or to nearby gas or liquids pipeline(s). The wells can be drilled further apart or closer together, depending on requirements. The barge 39 is maneuvered in position within the watch circle 41 by a tug boat 43 and thruster(s) installed on the barge. The watch circle 41 establishes the limits of the safe zone about the surface buoy 24. Well fluids are off-loaded to a cargo barge or other facility through an off-loading riser 44 which extends from the top side module 34 to the remote buoy 46. The barge is positioned at about 90° to the off-loading riser 44 and surface buoy 24 to facilitate off-loading of the hydrocarbons and minimize the risk for spillage. Produced gas which is not flared through the vent 36 may be exported via a pipeline connected to a gas export riser.

Figure 3:
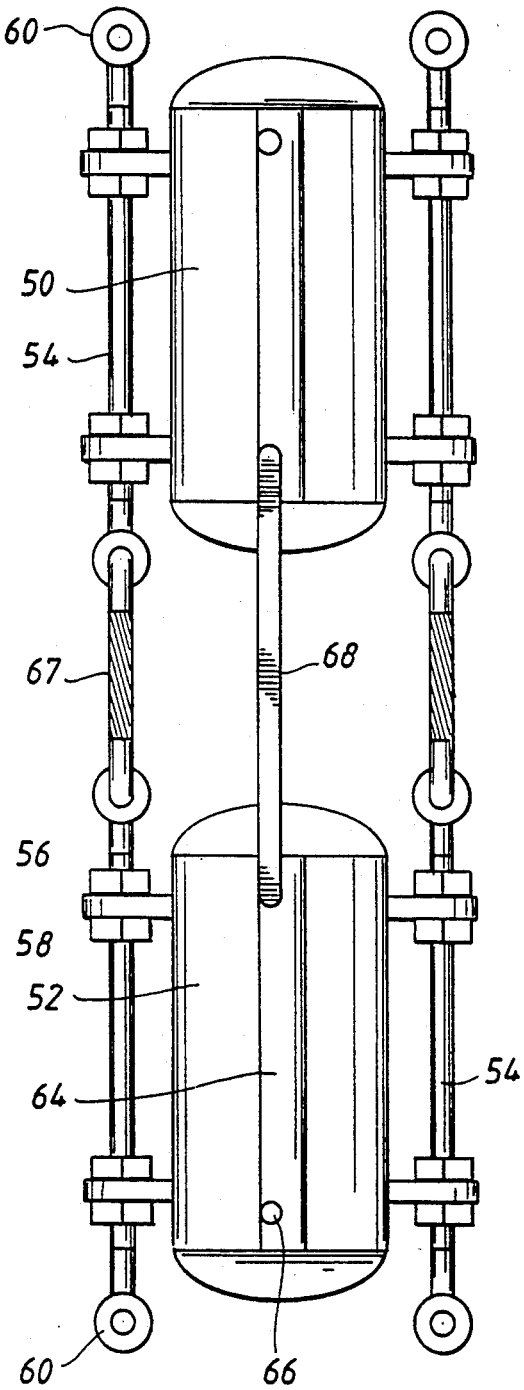
FIG. 3 is a side view of two vertically aligned tanks showing interconnecting components of the tendons and piping of the well tender system.
Figure 4:
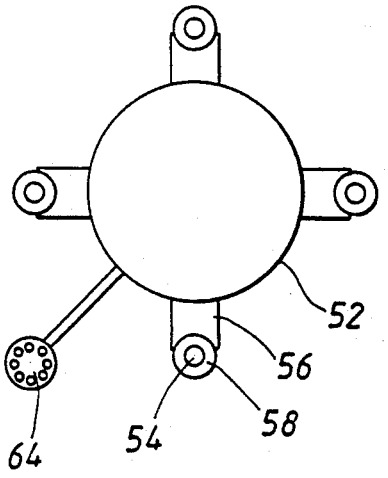
FIG. 4 is a sectional view showing the tendon body, permanent buoyancy tanks, and connectors.

Referring now to FIG. 3, two tanks 50 and 52 are tethered together with tendons 54 arranged about the periphery of the tanks 50 and 52. The tanks forming the vertically aligned series of tanks 12 shown in FIG. 1 are tethered together in the manner shown in FIG. 3. The tank string 12 is assembled on shore and towed to the off shore installation site. The fabricated tanks, such as tanks 50 and 52, are transported via trucks, rails, or barge to the onshore assembly site for installation of the tendon sections 54. Guides 56 are mounted to the tanks 50 and 52 by welding or the like. The guides 56 support the tendon sections 54 along the length of the tanks 50 and 52. The guides 56, as shown in FIGS. 3 and 4, comprise four sets of pairs of guides 56 which are spaced and aligned along the length of each tank 50 and 52 so that the tendon sections 54 are substantially equally spaced about the periphery of the tanks 50 and 52. In the preferred embodiment, each tank is provided with four tendon sections 54, that being the preferred number for the sake of symmetry, insuring that tensional loads on individual tendons are maintained at reasonable levels. It is understood however that fewer or greater number of tendons may be incorporated in the design of the well tender system 10. At least two tendons are required to avoid twisting. There is no upward limit on the number of tendons which may be utilized. However, if too many tendons are utilized, interference may become a problem. Eight tendons is considered a reasonable upper limit, avoiding the problem of interference yet reducing the tension load on each tendons to a level within the limit of many materials for fabricating the tendons.

Referring again to FIGS. 3 and 4, assembly of the tank string 12 is accomplished at an assembly site where the pre-fabricated tanks, such as tanks 50 and 52, are received and the guides 56 are welded, in aligned pairs, about the periphery of the tanks 50 and 52. The guides 56 may be separate and individual guide members as shown in FIGS. 3 and 4. Alternatively, the guides 56 may comprise a pair of collars mounted about the periphery of the tanks. The guide collars would include a plurality of equally spaced apertures for receiving the tendon sections 54 therethrough.

For purposes of illustration, the following discussion will be directed to the assembly of the tank 50 shown in FIGS. 3 and 4. It is understood however that each tank is assembled in the same fashion for incorporation in the tank string 12. Assembly of the tank 50 is accomplished by first pulling rigid tendon sections 54 through the guides 56. The tendons 54 are rigid for minimizing stretch. Cranes or other suitable lifting equipment lift the tendons 54 and position them for installation on the tank 50. A winch or the like is utilized to pull the tendon sections 54 through the guides 56. Alternatively, the tendons may be secured in the guides by a split clamp or the like. The tendon sections 54 are spaced from and level or parallel along the longitudinal length of the tank 50. The tendon sections 54 are secured to the guides 56 by nuts 58 which are made-up tight to the guides and welded to the tendon sections 54. Padeyes 60 are welded onto the ends of each of the tendon sections 54. Each of the tanks forming the tank string 12 are aligned end to end at the assembly site and tendon sections 54 installed in the manner described.

Upon completion of the installation of the tendon sections 54, adjacent tanks in the aligned string of tanks 12, such as tanks 50 and 52, are connected by flexible tendons 62 or the like which extend between the padeyes 60 of adjacent tanks. The flexible tendons 62 accommodate tank oscillations during tow and provide articulation for reducing upending stresses.

Pipeline bundles 64 are fabricated and clamped to each tank forming the tank string 12. The pipeline bundles 64 comprise rigid lengths of pipe contained in a casing that stand off a preselected distance from each of the tanks forming the tank string 12. An up-looking nozzle 66 is provided at each end of the pipeline bundles 64. A flexible intertank jumper or loop 68 is flange connected to the nozzles 66 for linking the pipeline bundles 64 between adjacent tanks 50 and 52. The intertank loops 68 provide fluid communication between tanks and topside equipment via the pipeline bundles 64. Gauges, instrumentation and hydraulic lines as required are installed to complete the assembly of the tank string 12.

Figure 5A:
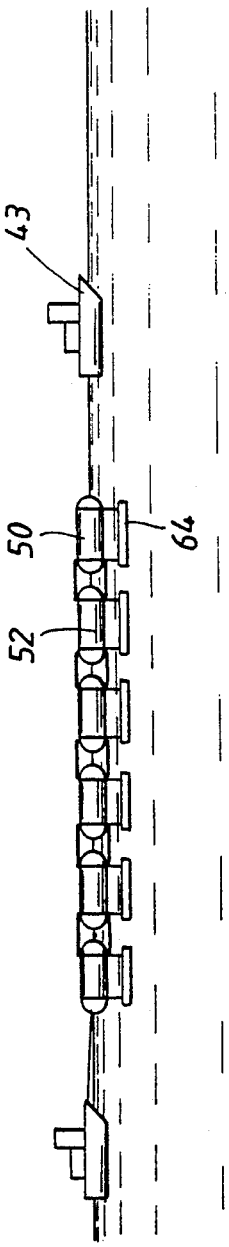
FIGS. 5A and 5B are elevational side views showing the tank installation sequence of storage tanks incorporated in the well tender system of the invention.

Once assembled, the tank string 12 is picked up by cranes and transported a short distance to a channel for towing to the offshore location. The tank string 12 is placed in the water and overturned to orient the pipeline bundles 64 beneath the tanks causing the pipeline bundle casing to flood. As the pipeline bundle casing floods, the tank string 12 rolls to a stable orientation for towing to the offshore site as shown in FIG. 5A. The flooded pipeline bundles 64 provide stability during towing and upending. The weight of these ballast tubes may be increased by attaching lengths of heavy chain to the pipeline bundles 64. Selected tanks may also be flooded as required to reach the proper towing configuration of the tank string 12 for towing to the offshore installation site. After installation, the ballast chain is removed and seawater is blown from the tanks into the sea using compressed air.

Figure 6:
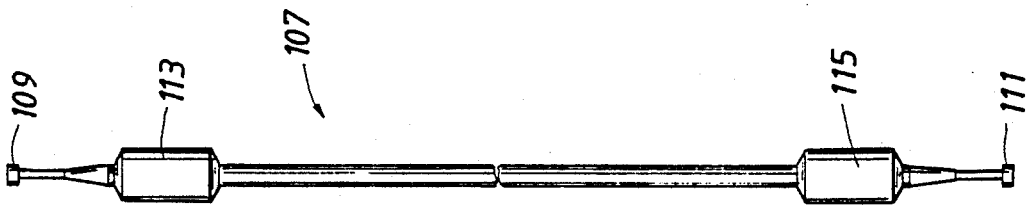
FIG. 6 is an elevational side view showing a tendon of the well tender system of the invention.

Referring now to FIG. 6, a tendon 107 of the well tendon system 10 is shown. The tendon 107 is representative of the tendons utilized in the well tendon system 10. It is understood that all tendons of the system 10 are substantially similar to the tendon 107 shown in FIG. 6. The tendon 107 may comprise a chain, wire rope, synthetic rope, heavy walled tubular or the like. The tendon 107 includes connectors 109 and 111 at opposite ends thereof. The connectors 109 and 111 are adapted for quick connect side entry connection with mating connectors carried on the surface buoy 24 and the pile 103 connector hub. The tendon 107 includes tendon buoys 113 and 115 adjacent the ends 109 and 111. Alternatively, the tendon to pile connection can be made by an in-line vertical connection means.

Figure 11:
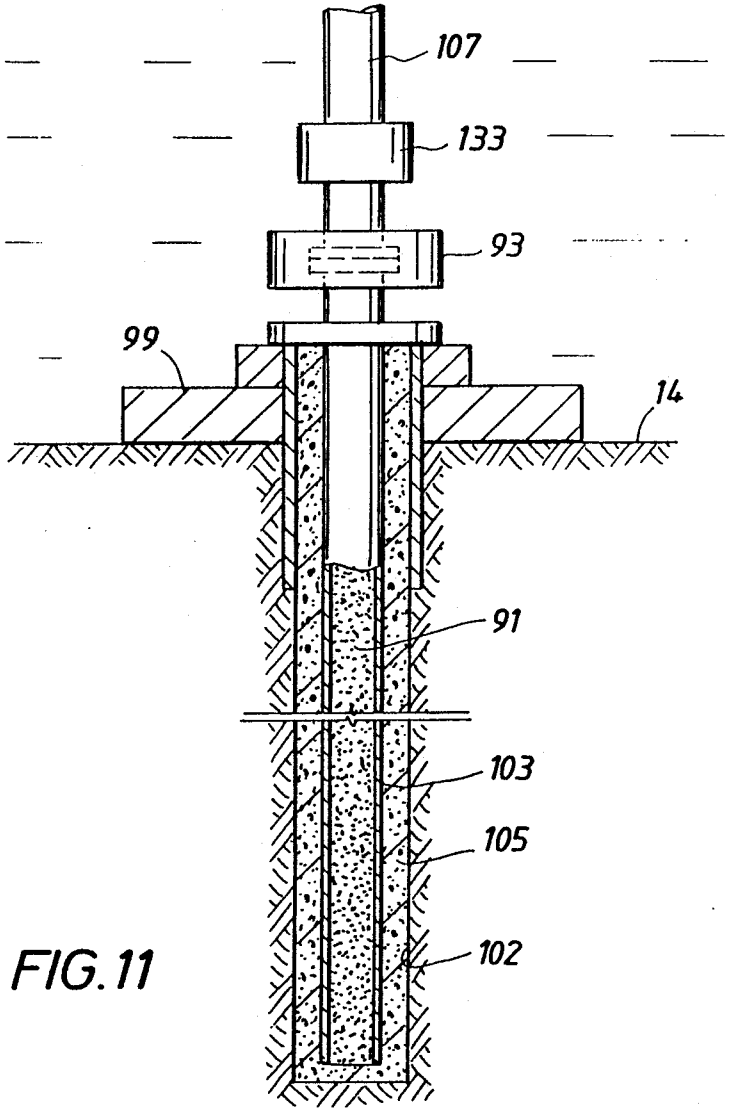
FIG. 11 is a sectional side view showing the foundation pile and its connection to the lower end of the tendon string of the well tender system.
Figure 12:
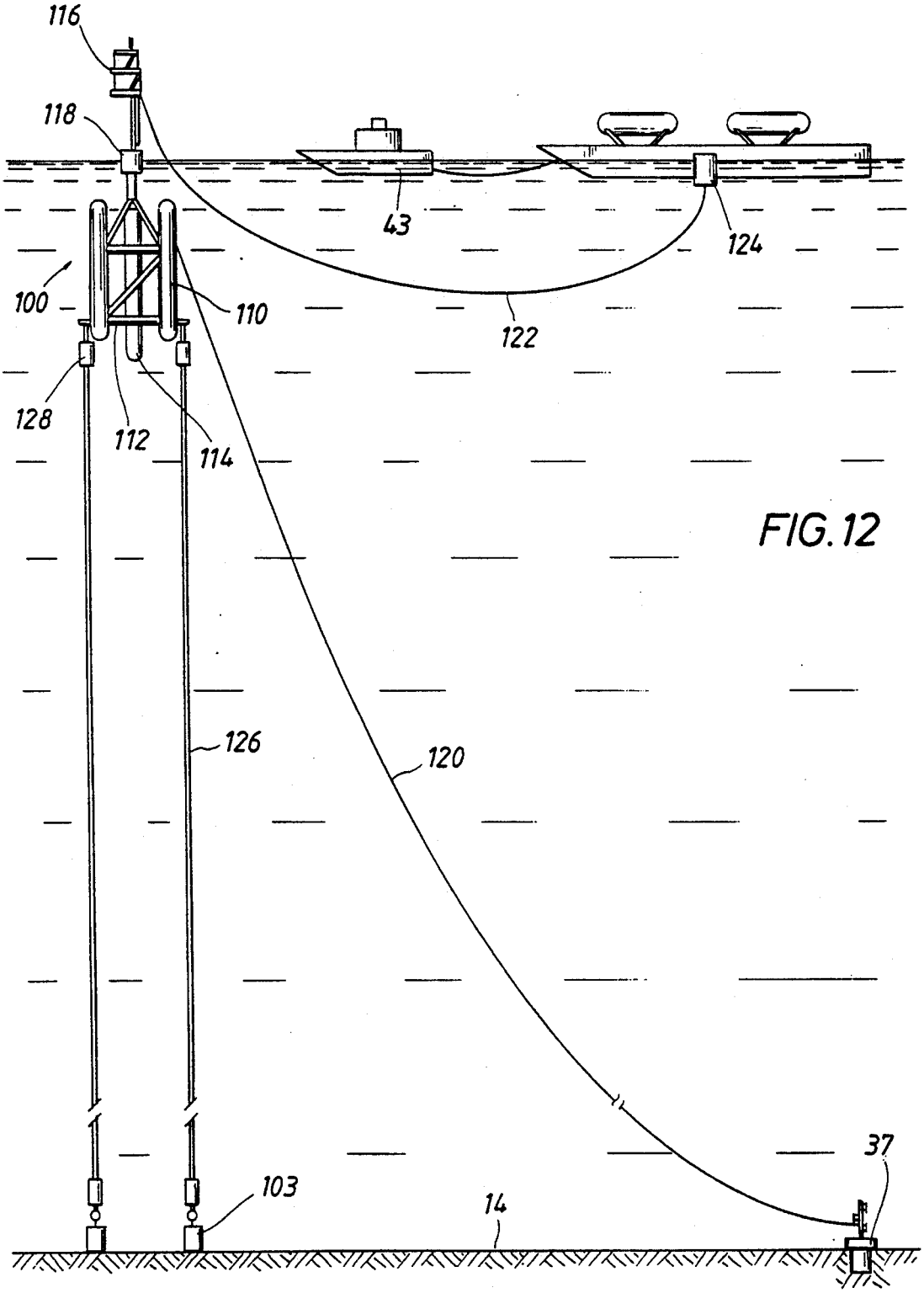
FIG. 12 is an elevational environmental view showing an alternate embodiment of the well tender system of the present disclosure.

The tendons 107 are anchored to foundation piles 103 cemented in the seabed 14. The foundation piles are formed by drilling two or more bores 102 into the seabed 14 at spaced out locations as best shown in FIG. 11. Initially, a foundation template 99 is lowered to the seabed 14 and jetted in place then the bores 102 are drilled to a depth sufficient to safely prevent pullout due to high tendon tensions. A length of casing 103 or the like is run into the bore and cement 105 is pumped into the bore to fill the annulus and secure the casing 103 in the bore 102. The casing can be filled with weighting material 91 to help resist pull-out forces by gravity. The cemented pile casing 103 is terminated at its upper end by a connecting hub 93 located at a pre-selected elevation above the seabed 14 where the lower ends of the tendons 107 connect to the pile 103.

The piles 103 are cemented in the bores 102 through foundation spacer templates 99. If the seabottom is irregular, the spacer templates 99 can be leveled relative to the seabottom so that the connecting hub 93 of each pile 103 is at substantially the same elevation above the seabed 14. Alternatively, piles can be driven into the seabed by means of an underwater hammer.

The tendons 107 are designed and constructed to be neutrally buoyant. The tendon buoy 113 installed at the upper end at the tendon 107 remains permanently void of water, even when the tendon 107 is in its installed position. The tendon buoy 115 at the bottom end of the tendon 107 is adapted to be quickly flooded. The bottom tendon buoy 115 remains void of water during towing to the well site and is flooded when the tug boats 43 and tendons 107 arrive at the well site to vertically orient the tendons 107.

The tendons 107 are assembled and welded together at the fabrication yard. When completed, they are individually transported to a well site between two tug boats 43 as will be hereinafter described in greater detail. In the tow out condition the top tendon buoy is buoyant, but has one compartment full of ballast water. A control line connected to flooding mechanics on the bottom tendon buoy 115 enables the operator to quickly flood the tendon buoy 115 when the well site is reached. During transportation to the well site, the following tug boat 43 has flooding responsibility for the bottom tendon buoy 115. If the weather becomes too rough and the tendon 107 has to be dropped by the tug boats, the flooding line is pulled from the following tug boat which causes the bottom tendon buoy 115 to fill with water and sink toward the seabed 14. The top buoy 113 remains buoyant but with one compartment full of ballast water. The top tendon buoy 113 has greater buoyancy than the flooded bottom tendon buoy 115. Thus, the tendon 107 is vertically oriented and can easily be recovered.

Figure 7A:
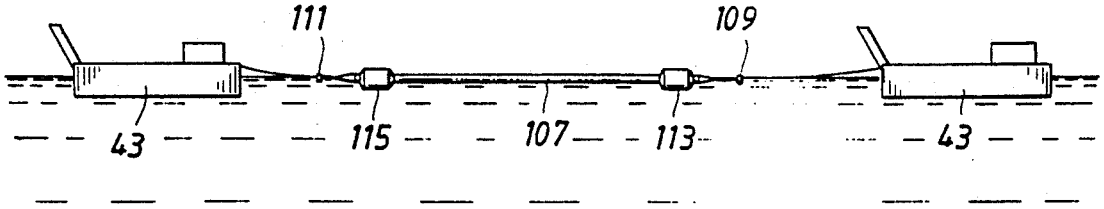
FIGS. 7A–7K are elevational side views showing the tendon installation sequence of the well tender system of the invention.
Figure 7B:
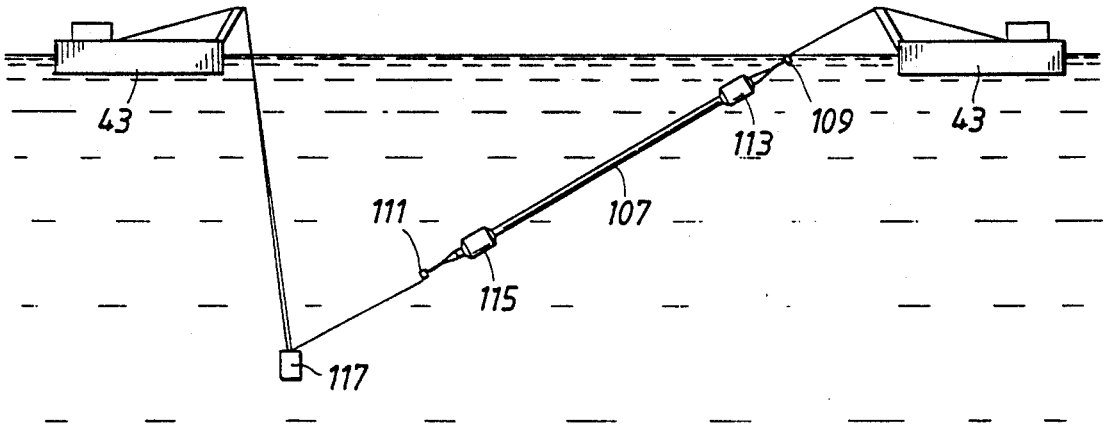
Figure 7C:
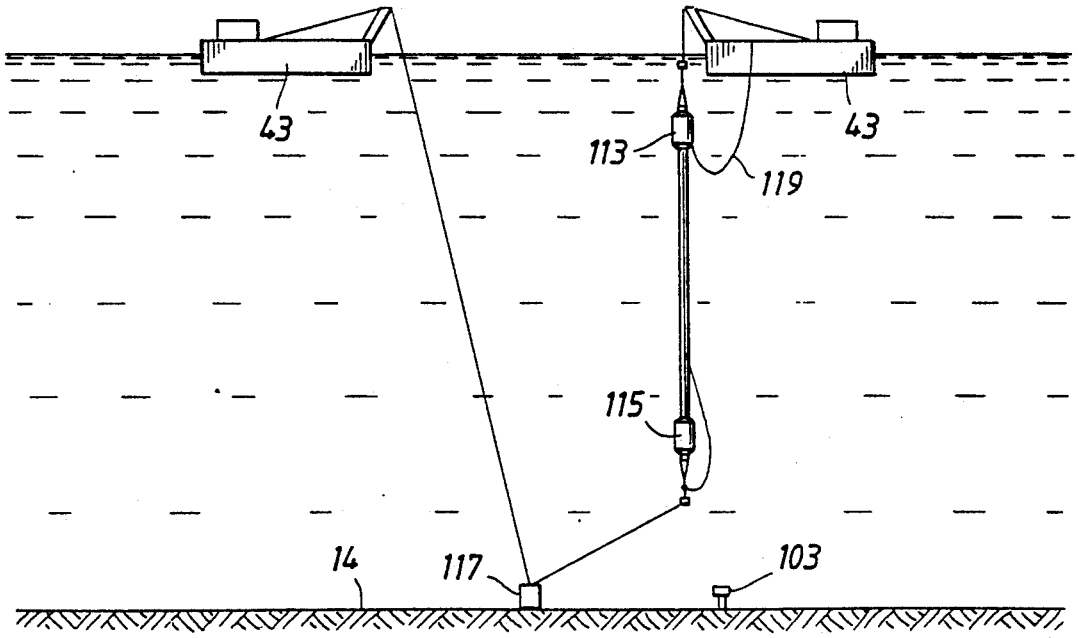
Figure 7D:
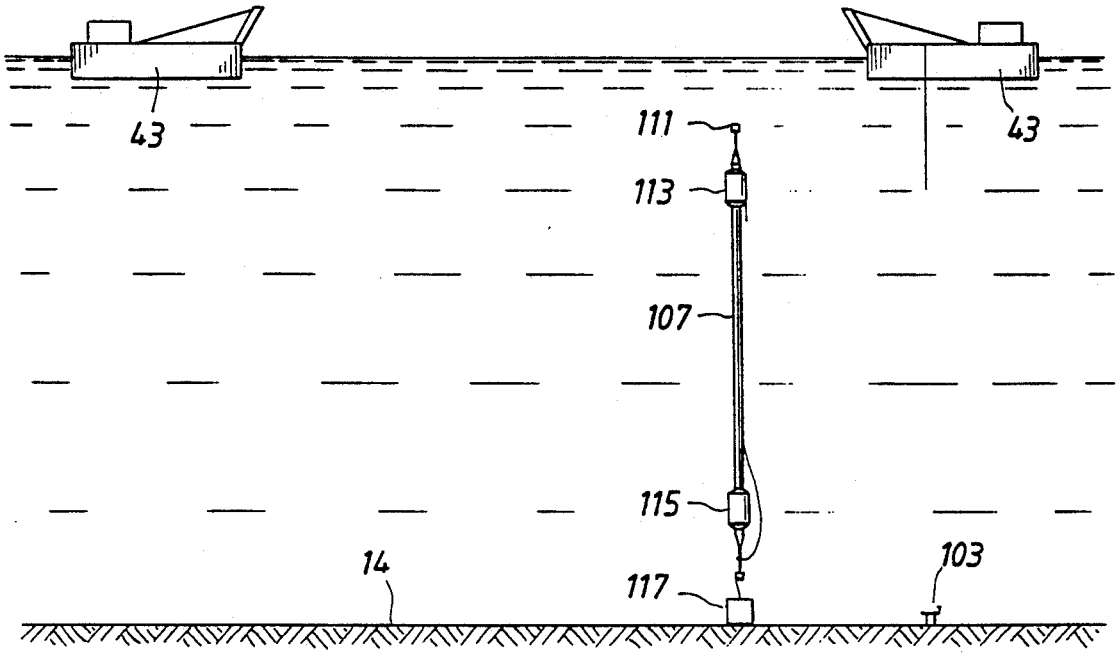

Referring now collectively to FIGS. 7A through 7K, towing and installation of the tendons 107 at the well site will be described. As noted above, the tendons 107 are transported to the well site between tug boats 43 as shown in FIG. 7A. When the tug boats 43 arrive at the offshore installation site, the following tug boat pulls its flooding line to flood the bottom tendon buoy 115. A clump weight 117 connected to the end 111 aids in lowering the tendon 107 and temporarily holds it in position for subsequent connection to the tendon foundation pile 103 as best shown in FIGS. 7B and 7C. When the clump weight 117 is landed, an air line 119 is connected to the top tendon buoy 113. The top tendon buoy 113 is then completely deballasted so that it is tensioned for abandonment. The tug boats 43 separate from the tendon 107 leaving it secured to the weight 117 as shown in FIG. 7D and return to base to retrieve another tendon or component of the system.

Figure 7E:
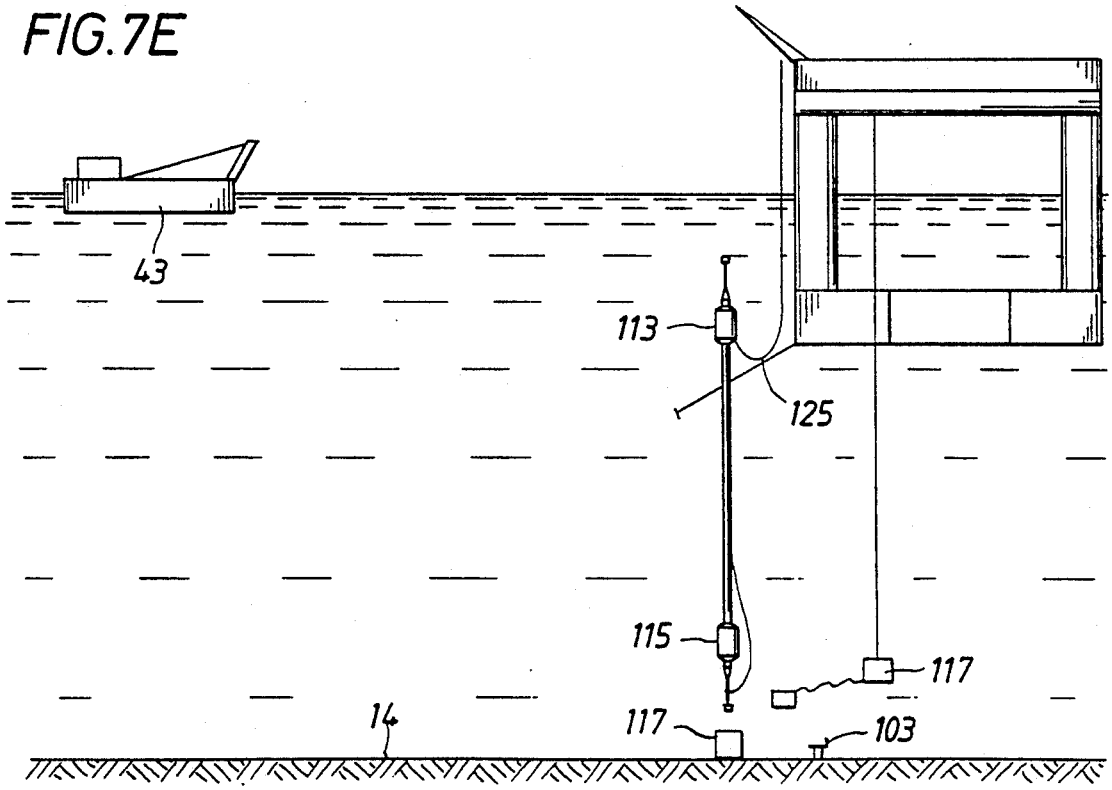
Figure 7F:
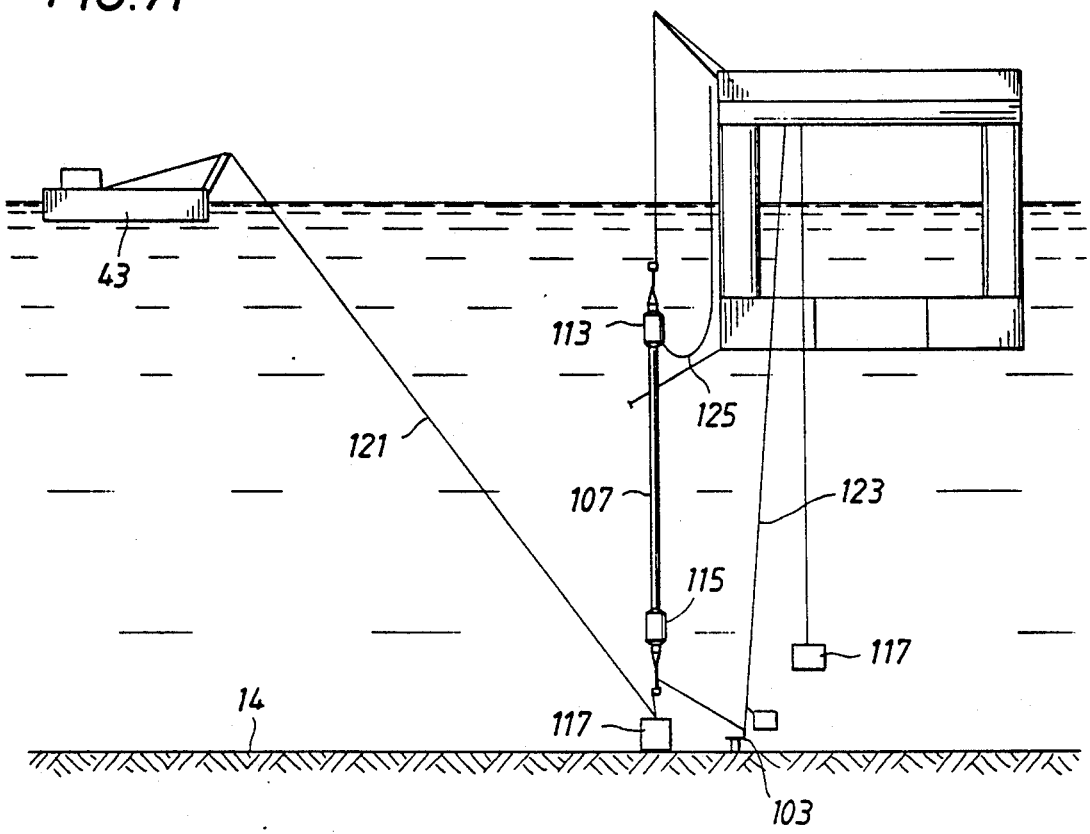
Figure 7G:
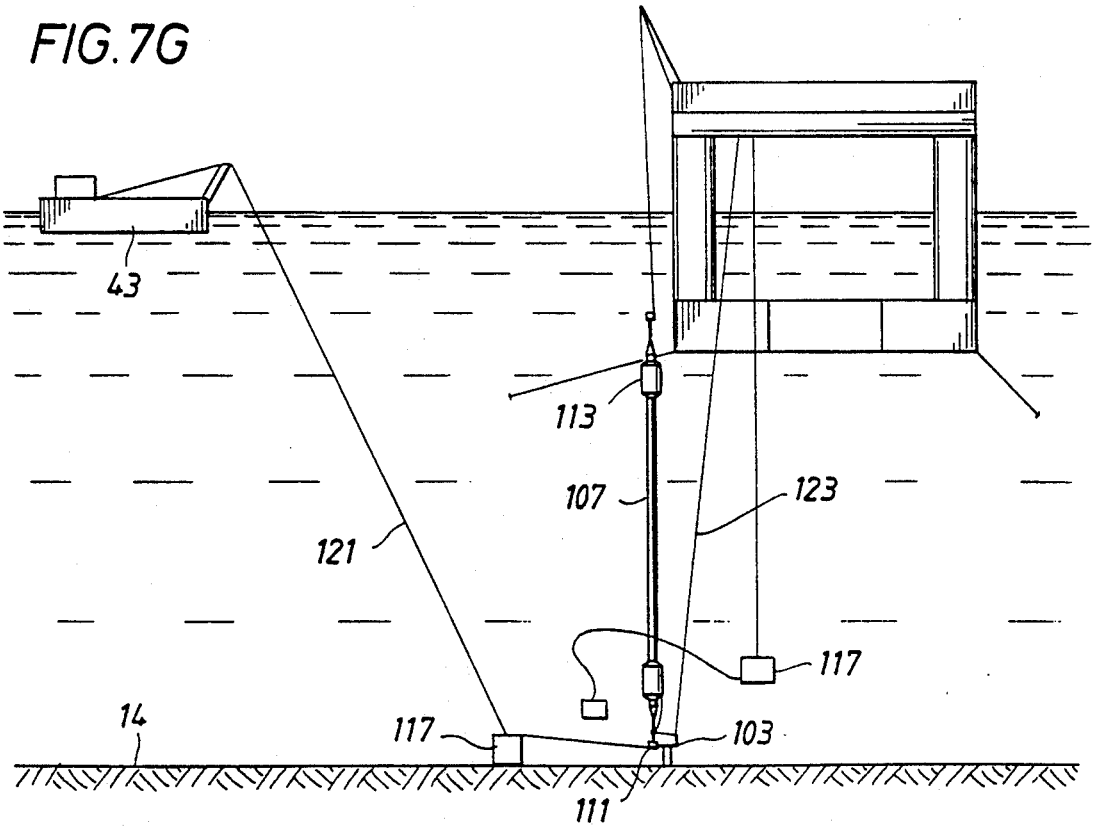
Figure 7H:
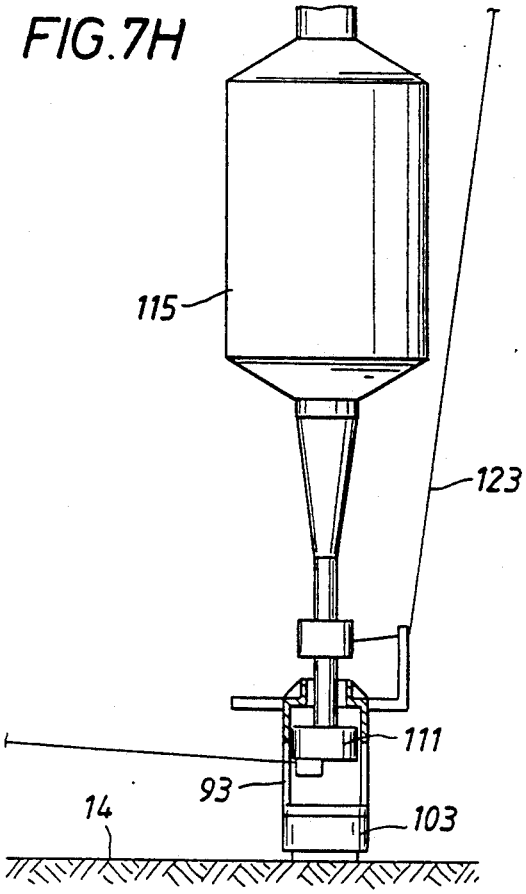
Figure 7I:
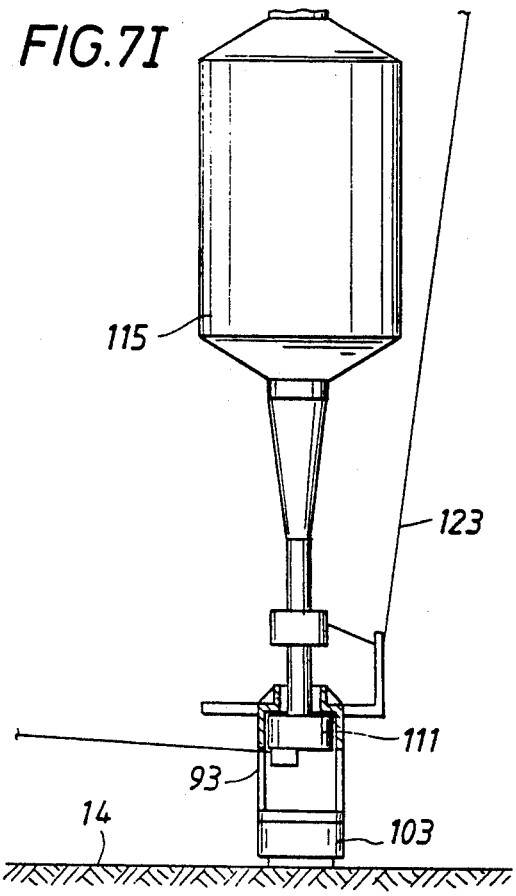
Figure 7J:
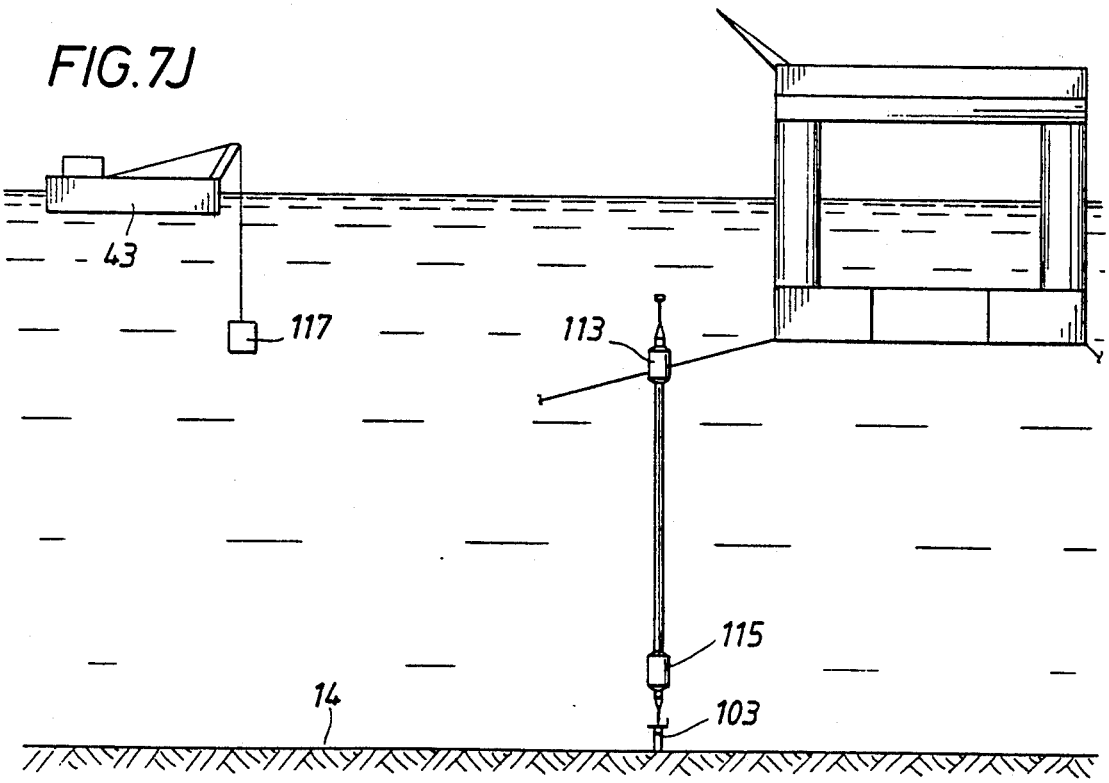
Figure 7K:
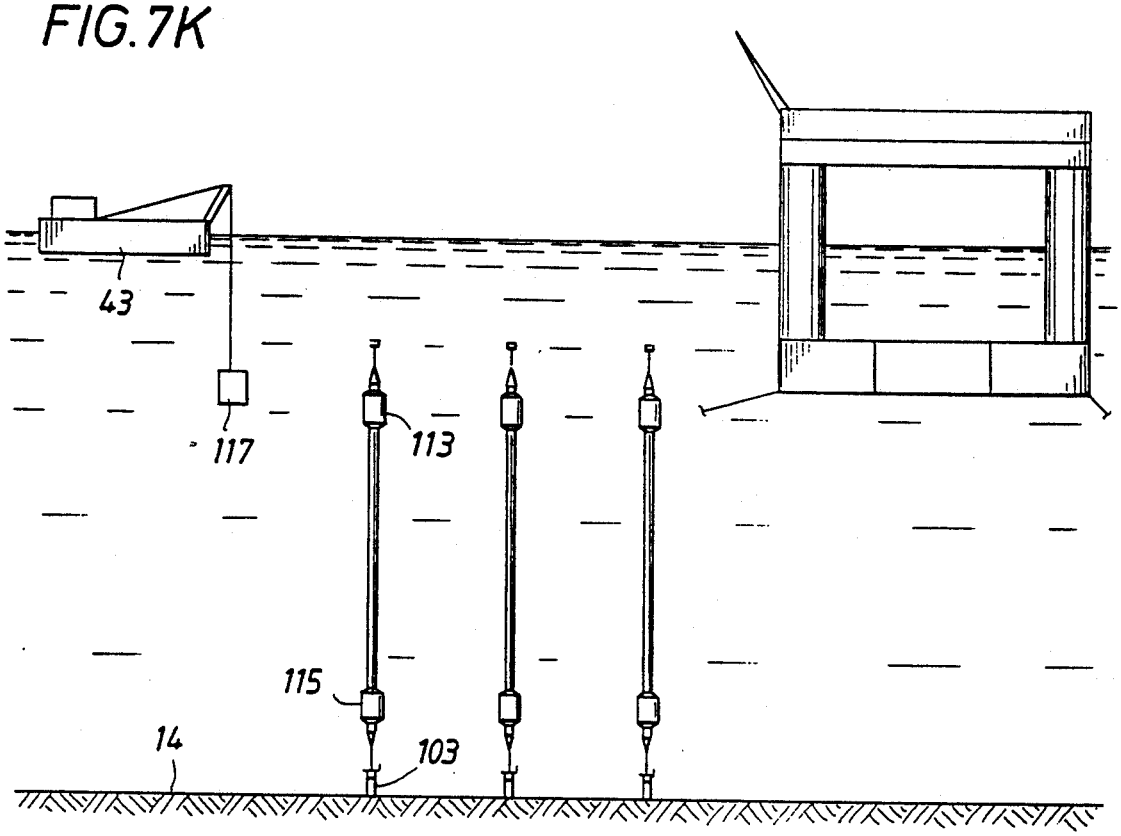

Once the tendon 107 is located at the tendon site, the Mobile Offshore Drilling Unit (MODU) or other work vessel mobilizes a Remote Operated Vehicle (ROV) to connect pull lines 121 and 123 to the bottom end 111 of the tendon 107. An air line 125 and crane line 27 are connected to the top tendon buoy 113 and upper end 109 of the tendons 107, respectively, as shown in FIGS. 7E and 7F so that the tensioning compartment is filled. The pull lines 121 and 123 are utilized to pull the lower end 111 of the tendon 107 into the foundation receptacle or hub connector of the foundation pile 103. The lower end 111 of the tendon 107 is pulled toward the hub connector and aligned with the mouth of the receptacle for side entry into the hub connector as shown in FIG. 7H. The tendon 107 is then pulled up with the MODU's crane so that the lower end 111 of the tendon 107 rises into engagement with the hub connector as shown in FIG. 7I. The air line is then used to completely debal-last and tension the pre-installed tendon so that the crane line can be disconnected to complete the tendon connection to the foundation pile 103. The pull lines 121 and 123 are then disconnected from the tendon 107 (shown in FIG. 7J) and the sequence is repeated until the desired number of tendons 107 are anchored to the seabed 14 as shown for illustrative purposes in FIG. 7K.

To prevent tendon entanglement and to facilitate the installation of the surface buoy 24, a tendon spacer apparatus may be installed on the tendons 107 just below the top tendon buoys 113. The spacer is utilized to keep the tendons 107 spaced apart, and it is slightly positively buoyant. It may be formed in any shape necessary to properly space the tendons and may comprise a frame formed of welded and/or bolted together tubular steel members.

Figure 8A:
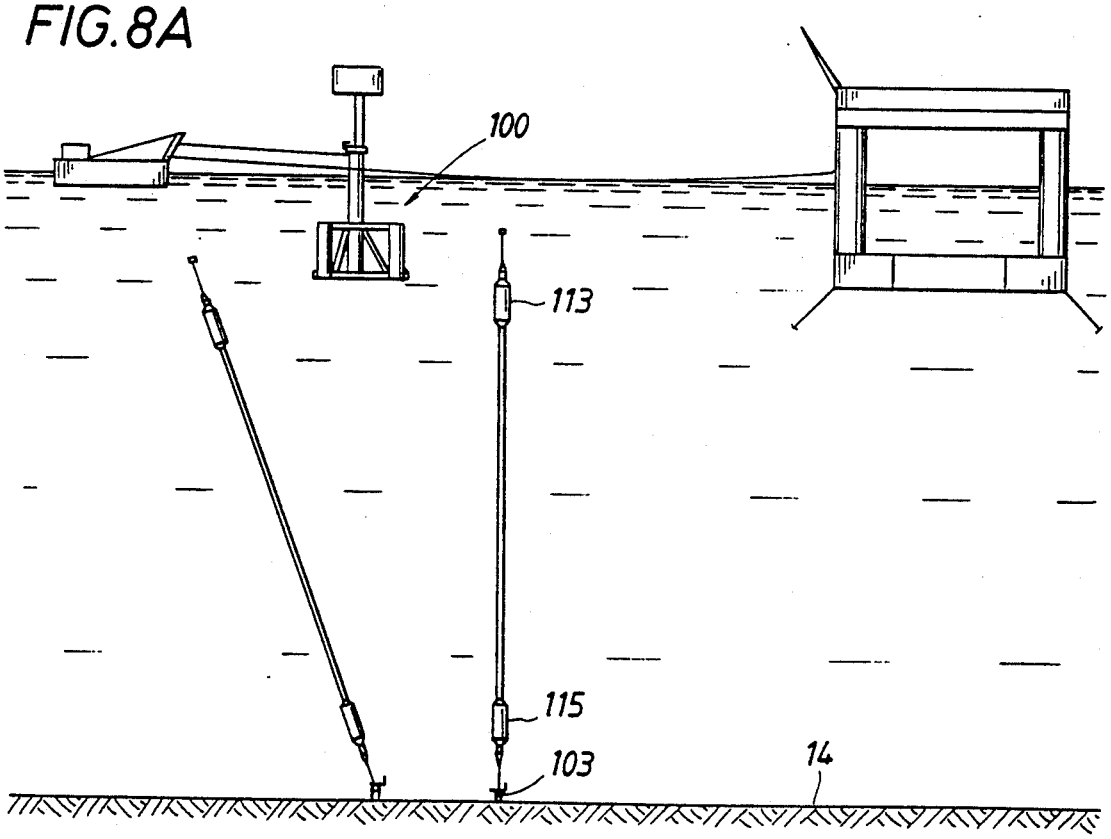
FIGS. 8A–8C are elevational side views of the well tender system showing the surface buoy installation.
Figure 8B:
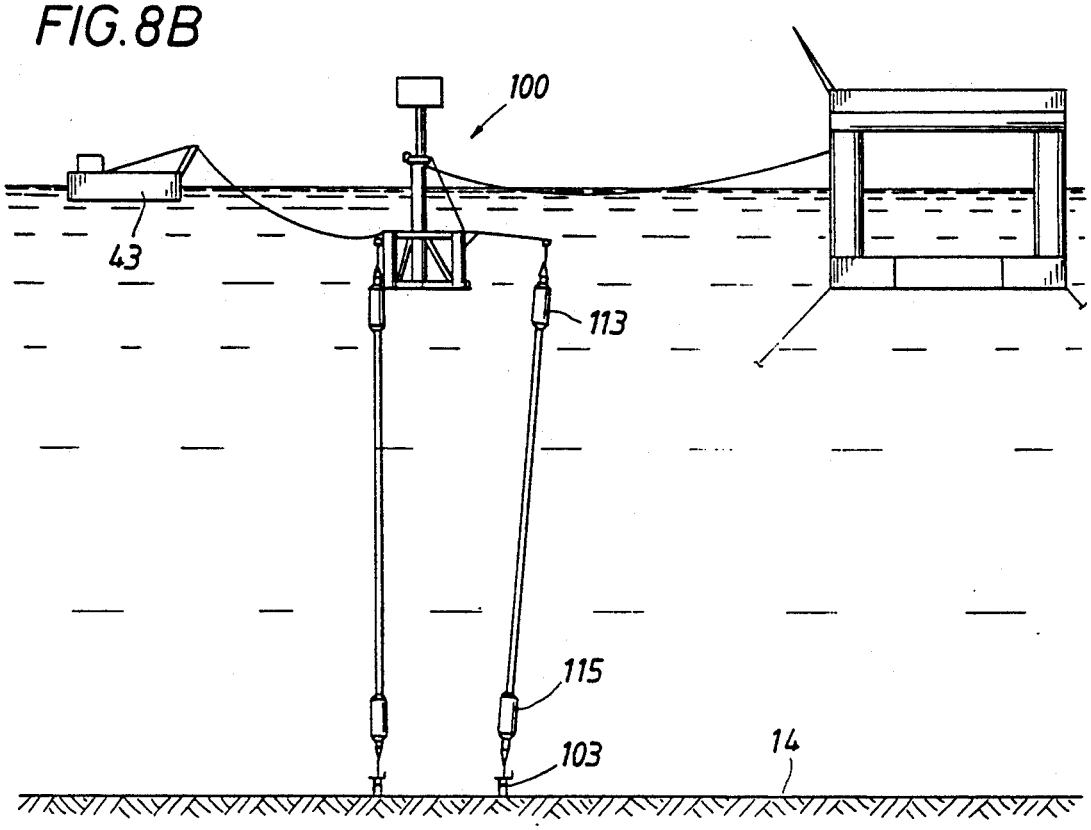
Figure 8C:
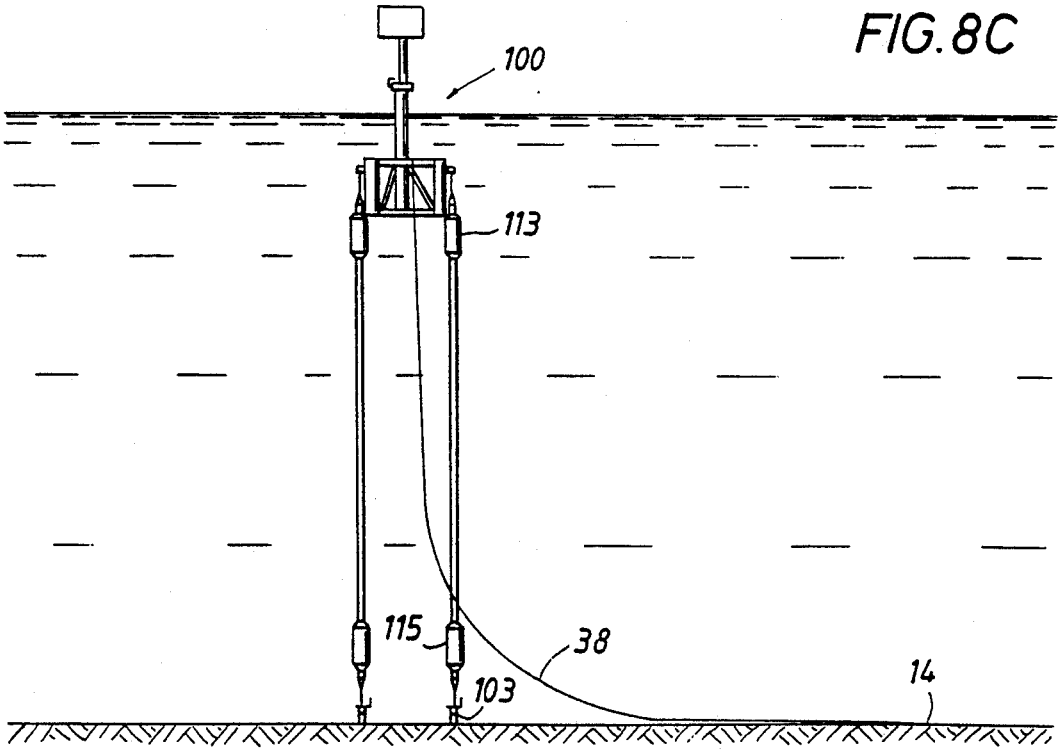

Referring to now FIGS. 8A through 8C, the surface buoy installation sequence is shown. The surface buoy 24 is towed to the installation site and is positioned in the center of the tendon 107 arrangement just above the tendon spacer, if one is utilized. To facilitate the positioning of the surface buoy 24, the tendons 107 may be pulled aside as required as shown in FIG. 8A. Once the surface buoy 24 is properly positioned, a pull line is attached to the upper end 109 of one of the tendons 107 and pulled into the connector receptacle located on the surface buoy 24. A side entry connector is utilized to facilitate connection of the tendons 107 to the surface buoy 24. The side entry receptacles are formed in porches 101 on the external tanks 110. Porches 101 for the risers 38 and 40 are mounted on the pontoons 112 and/or the external tanks 110. The sequence is repeated until all tendons 107 are secured to the surface buoy 24. The flowline and export risers are then connected to complete the installation.

Alternatively, if a chain, wire rope, or synthetic rope tendon is employed, the tendon can be deployed from a portable powered reel located on the MODU. In this case, the tendon is unreeled through the moonpool of the MODU and connected to the cemented foundation pile 103.

Figure 5B:
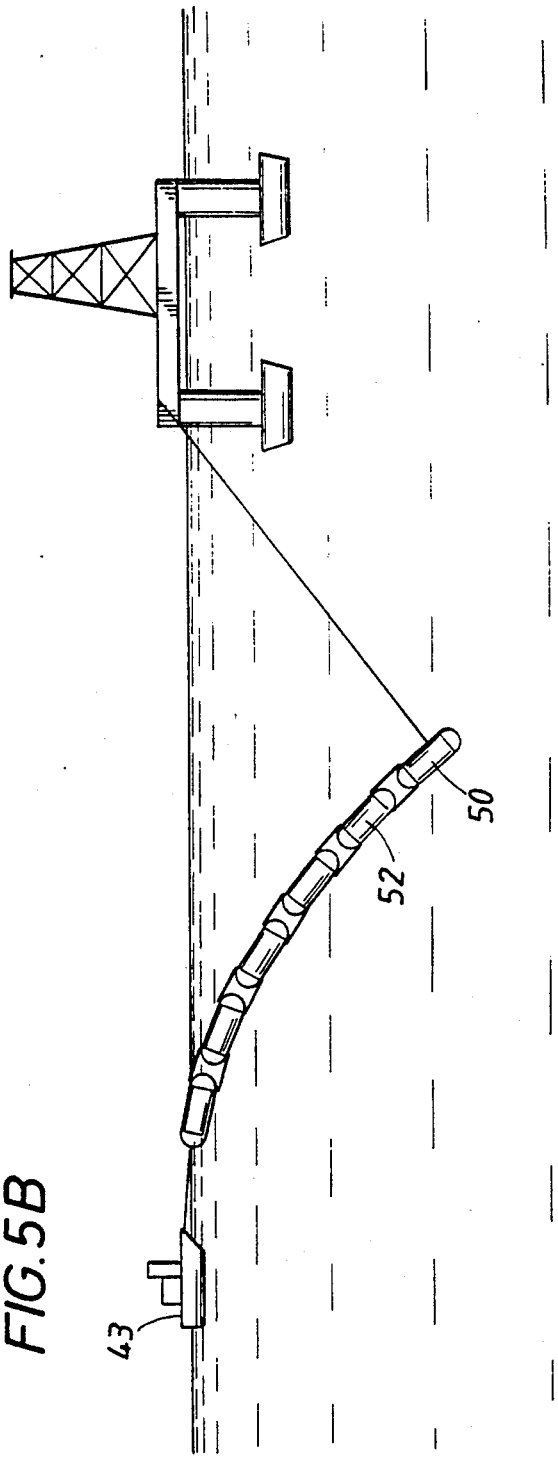

If storage tanks are required, the tank string 12 is first towed to the vicinity of the MODU and preparations made for upending as shown in FIGS. 5A and 5B. Beginning with tanks in the towing ballast condition, with positive buoyancy, the tow line attached to the lowest tank is passed to the MODU. One or more upper tanks are voided and lower tanks flooded creating tension on the MODU supported tow line. The bottom tow line is slacked and the string uprights pivoting about the upper buoyancy tank. The bottom tow line is released and the top tow line passed under the MODU and up to the moonpool area. The top tanks are flooded and the string is keelhauled underneath the MODU. The tank string is maneuvered into the proximity of the tendon buoys and the pulling line is connected between one tendon buoy and one chain tendon on the bottom of the tank string. The MODU moves over and deballasts all tanks with compressed air.

The surface buoy 24 and deck are towed to location at or near installation draft. A line is passed from the surface buoy to the MODU so that the surface buoy is secured between the MODU and tugs thrusting away from the MODU. The surface buoy is then pulled toward the MODU into position over the tank string 12. The surface buoy to tank string connection is then made in the same manner as the tank string to tendon buoy connection described above. Temporary ballast on the surface buoy is blown to pretension the tendons.

Flowline and export risers 38 and 40 are installed with slack or tensioned catenaries as appropriate. The MODU supports hookup and commissioning activities. Flexible pipe or spool-piece connections are made with diver assistance between piping on the surface buoy 24 and piping on the lower tank string 12.

Figure 10A:
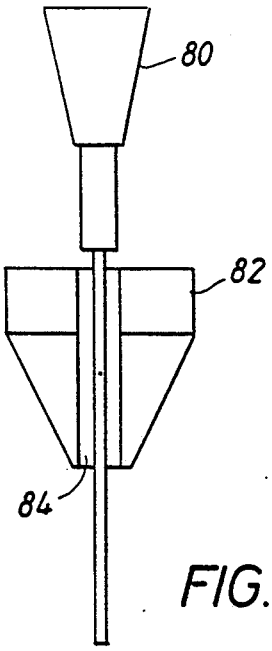
FIGS. 10A and 10B are partial side views showing the side entry connector sequence for connection of the flexible production riser bundle to the well tender system.
Figure 10B:
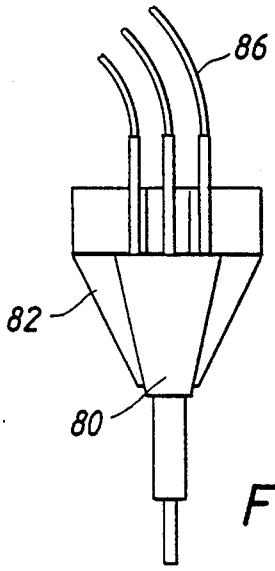
Figure 13:
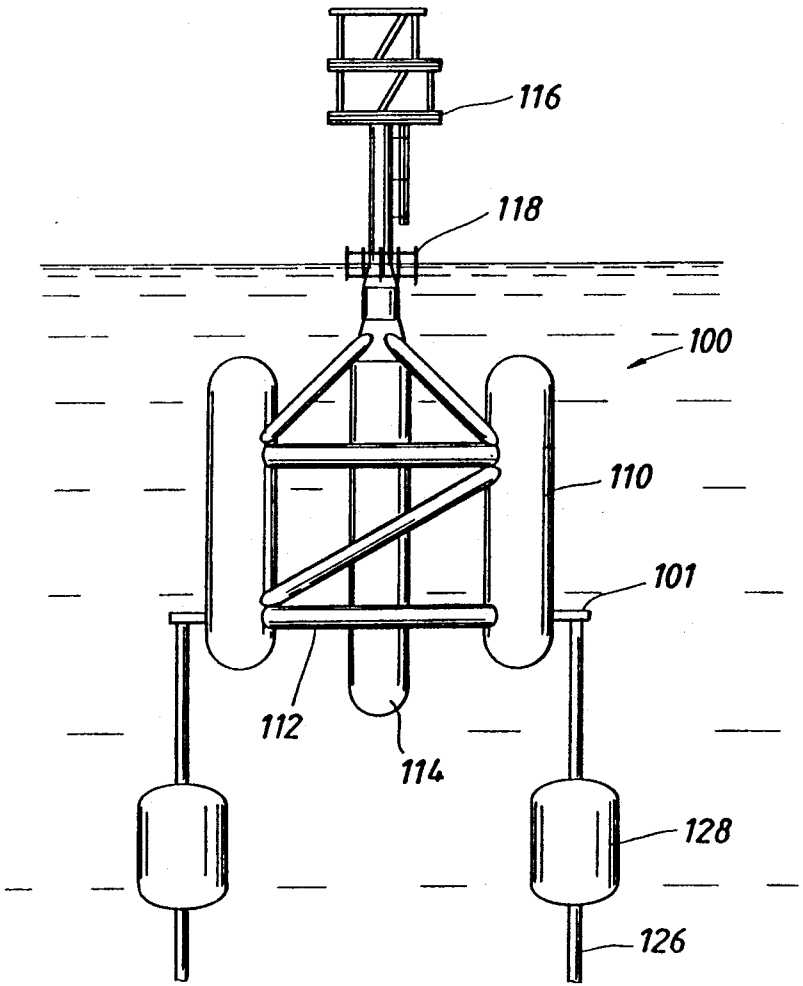
FIG. 13 is a elevational side view of the surface-piercing buoy of the alternate embodiment of the invention.

Referring again to FIGS. 1 and 4, it will be observed that the flowline risers 38 connect the wells 37 to the periphery of the tank string 12. The riser bundles 38 are connected to the periphery of the tank string utilizing a side entry flexible riser connector shown in greater detail in FIGS. 10A and 10B. The side entry riser connector 80 is received by a connector receptacle 82 which includes a longitudinal slot 84 along one side thereof for receiving the flow line riser 38 laterally therethrough. The connector receptacle 82 defines an internal recess which is substantially conical in shape corresponding to the conical profile of the connector 80. The connector 80 is received within the receptacle 82 and can only be disengaged by opening a gate, forcing the connector 80 upwardly out of the receptacle 82 and then laterally moving the flowline riser 38 through the slot 84. Flexible flow line jumpers 86 (shown in FIG. 10B)connect from top of flowline risers 38 to hard piping runs on the surface buoy 24 which provides fluid communication to topside equipment.

Figure 9:
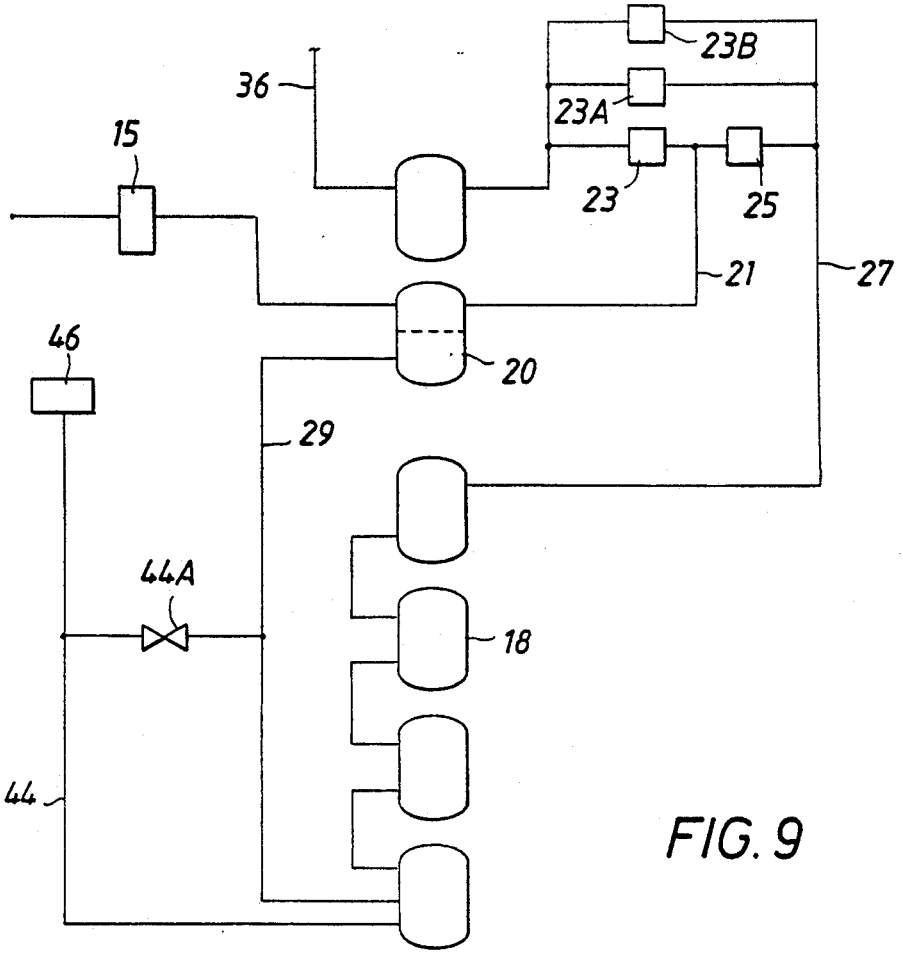
FIG. 9 is a flow diagram schematically showing the arrangement for controlling, storing and disposing of production fluids.

Referring now to FIG. 9 and for purposes of illustration, flow of oil and gas from the wells 37 to the tank string 12 is schematically shown. Production of oil and gas from the wells 37 is delivered through the production choke 15 to the separator 20. The separator 20 is located on the deck. In the separator 20, gas and liquid are separated. The gas is directed via line 21 to be vented through vent 36. Alternatively, the gas may be exported via the gas export riser 40. For safety purposes, over pressure relief valves 23, 23A and 23B are provided in the event line pressure exceeds a predetermined maximum value. A back pressure control valve 25 in the line 27 which is in fluid communication with the oil storage tanks 18 holds back pressure on storage tanks. If required, valve 25 opens to allow the gas produced from the wells 37 to push liquid out of the pressurized storage tanks 18 during offloading to a cargo barge or other satellite facility.

The fluids separated in the separator 20 are directed to the storage tanks via the fluid line 29. The storage tanks 18 are filled from the lowermost tank upward as showed in FIG. 9. Well fluids are off-loaded to a cargo barge or other satellite facility via the off-loading riser 44 which is connected to a remote off-loading buoy 46. Alternatively, fluids can flow directly from the separation plant through the offloading line 44 through the by-pass valve 44A.

Referring next to FIGS. 12–16, an alternate embodiment of the invention is shown. This configuration eliminates all underwater hydrocarbon-containing tanks and separate buoyancy tanks. In some applications, it may be desirable to locate all production vessels and equipment on the deck supported above the waterline. For this configuration, a surface-piercing buoy 100 provides positive buoyancy and vertical support to the entire tendon system of the invention and supports the production deck which is large enough to accommodate the equipment necessary to process the oil, gas and water produced from the subsea reservoir.

The surface-piercing buoy 100 consists of one, two, three four, five, or six submerged vertically-oriented external tanks 110 comprised of steel or other material. The size, number, and composition of the tanks 110 depends on the application. The tanks' cross-section can be circular, rectangular or any other suitable shape as required. The tanks 110 are incorporated into a framework of steel pontoon braces 112 that are themselves buoyant, and as a unit the pontoon braces 112 comprise the substructure portion of the surface-piercing buoy 100. At the center of the buoy 100 is a central flotation column 114 extending from the bottom of the buoy 100, up through the water surface and up to the production deck 116. The large diameter central flotation column 114 supports the production decks 116, which may include one or more decks, and the equipment. A boat landing 118 is attached to the column 114 at the waterline, and it may extend partially or completely around the central column 114. The superstructure of the surface-piercing buoy 100 comprises one or more decks, and is constructed of steel or other materials, as applicable, to accommodate the equipment required to process, compress, and inject the fluids, gas or liquid, produced by any particular reservoir. For example, the surface-piercing buoy 100 may include a helideck and one or more decks which may accommodate no processing equipment, simple test equipment, or full processing equipment.

The central column 114 is compartmentalized for damage control. It includes a ballast manifold with submersible electrical pump to ballast and deballast depending on operational conditions at a location. Each central column 114 may range in size from three feet to fifty feet in diameter depending upon the application, and this diameter may vary on a single, central column. The bottom of the central column 114 may extend as deep as 250 ft. below the water surface, and it will extend up to the lower deck elevation. Likewise, the external tanks 110 are compartmentalized for ballasting operations and for damage control. The ballast compartments of the tanks 110 are piped to the submersible pumps in the central column 114.

Flow is conducted from the remote wells, which are external to the central processing unit, to a point at the periphery of the structure and up one or more flowline jumpers to the production deck 116, where it is injected into the equipment for processing. Multiple flowline risers 120 may be bundled or may extend up to the surface individually, as desired by the operator. Each riser 120 is in the form of a flexible catenary line and may be comprised of flexible or rigid material. Each riser 120 may be a tensioned flowline riser with subsea connection. The catenary risers 120 may also provide a restoring torque that aids to stabilize the vertical mooring system. Depending on water depth and corresponding water temperature, the flowline risers 120 may be insulated to maintain flowline temperature to prevent hydrate formation.

The risers 120 extend from each remote well 37 to the central processing unit and are equally sized permitting pigging of the flowlines from the production deck 116. It is operationally desirable for each well to have an individual flowpath from the subsea well 37 to a flow control choke at the production deck 116. For gas wells, it is operationally desirable to have a third, smaller line to carry hydrate control chemicals downhole to each well 37.

A separate service riser bundle 122 extends from the surface buoy production deck 116 through a catenary or floating hose to a pick-up buoy 124 that allows the production system to be serviced and off-loaded. In the absence of a liquid pipeline, produced oil can be off-loaded by one or more vessels keeping station in a watch circle around the surface buoy 100. During off-loading, liquids in the underwater pressurized storage tanks flow to tanks maintained at a lower pressure on a shuttle vessel in fluid communication with the pick-up buoy 124. Liquids flow directly to the shuttle vessel from the production deck 116 when the shuttle vessel is on station and connected. In this alternative, oil may also be stored and off-loaded from oversized tendon buoys 128 equipped with double hull or storage compartment tanks. It is also possible to include no storage and produce only when the shuttle is in fluid communication.

The surface buoy 100 shown in FIGS. 12–15 is installed at the offshore well site by controlled flooding of the central flotation column 114 and the vertically oriented tanks 110, causing the surface-piercing buoy 100 to be lowered in a vertical position for attachment to the top of the vertically positioned tendons 126. With the surface-piercing buoy 100 in a ballasted condition, upper ends of the tendons 126 which are anchored at the opposite ends to the foundation piles 103 are connected to the surface buoy 100 by a remote manually operated submerged vehicle and/or by divers. All ballast is then removed from the tanks 110 and central flotation column 114, thereby completing the installation of the well tender system of the present disclosure.

The tendons 126 are connected either to the pontoon braces 112 or the external tanks 110. Up to five connecting tendons 126 may extend from each pontoon brace 112 or tank 110 to the seabed 14. The tendons 126 may comprise single-piece tendons or multiple-piece tendons designed to be either neutrally buoyant or negatively buoyant. The tendons 126 are secured to the surface buoy 100 and the foundation piles 103 at the seabed 14 by means of a vertical stab connection or side-entry connection as previously described.

Figure 16:
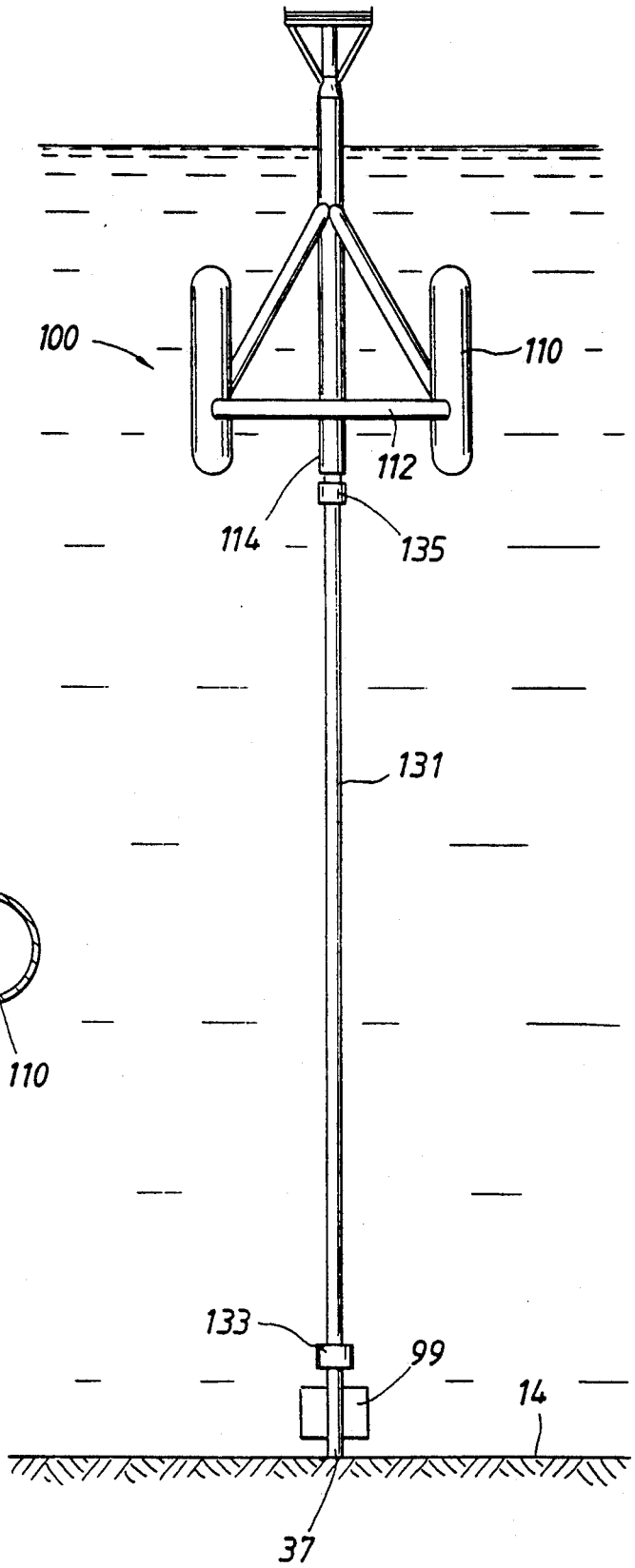
FIG. 16 is a elevational side view of the surface-piercing buoy tethered to a satellite well.
Figure 15:
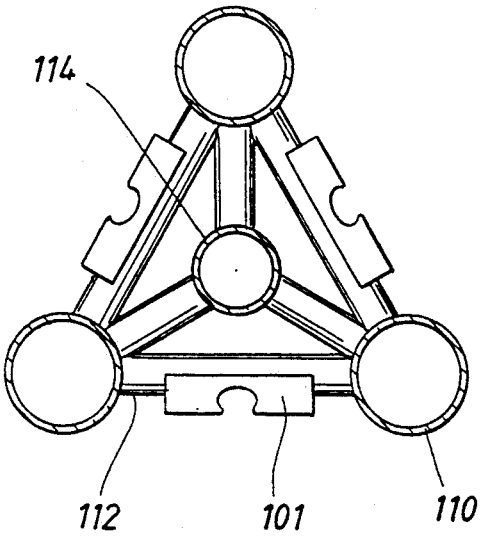
FIG. 15 is a plan view showing the riser porch connectors secured to the surface-piercing buoy.

Referring now to FIG. 16, the surface buoy 100 is shown installed directly above well 37. Installation of the surface buoy 100 is accomplished in substantially the same manner described above except that the lower end of the flotation column 114 is connected to the upper end of an upstanding conductor pipe 131 which extends above the well 37. The conductor pipe 131 is connected to the well 37 by flex joint device 133 permitting the surface buoy 100 to oscillate slightly relative to the subsea well 37. A flex joint 135 is also located at the upper end of the conductor pipe 131 for connection to the surface buoy 100. The surface buoy 100 is positively buoyant so that the conductor pipe 131 is maintained in tension and functions substantially as a tendon in the manner previously described.

While the foregoing is directed to the preferred embodiment of the present invention, other and further embodiments of the invention may be devised without departing from the basic scope thereof, and the scope thereof is determined by the claims which follow.

What is claimed is:

1. A subsea well tender system comprising a surface buoy having at least three submersible brace members spaced about a surface-piercing central flotation column connected to said brace members, wherein said surface piercing flotation column supports one or more decks above the water surface for accommodating equipment to process oil, gas, and water, and further including mooring means securing said surface buoy to the seabed.

2. The system of claim 1 wherein said mooring means comprises at least two tendons having one end anchored to the seabed and the other end connected to said surface buoy.

3. The system of claim 2 wherein said tendons include a tendon flotation buoy adjacent each end of said tendons, said flotation buoys supporting said tendons in a horizontal orientation when said tendons are being towed for installation at the subsea well site, and wherein said tendons are neutrally buoyant.

4. The system of claim 3 wherein said tendons are vertically oriented by flooding or removing one of said tendon flotation buoys connected to the ends of said tendons.

5. A method of installing a floating platform for recovering well fluids from a subsea well, comprising the steps of:

(a) towing tendon means to the subsea well site, wherein said tendon means include a tendon flotation buoy secured adjacent each end of said tendon means;

(b) flooding or releasing one of said tendon flotation buoys for vertically orienting said tendon means for connection to anchor means located on the seabed;

(c) connecting said tendon means to said anchor means;

(d) loading a hull and deck on to a floating vessel and towing the vessel to the vicinity of the subsea well;

(e) unloading the hull and flooding selected compartments of the hull for lowering the hull to a preselected depth;

(f) connecting said tendon means to the hull and deballasting the hull to tension said tendon means;

(g) securing the deck to the hull;

(h) establishing fluid communication between the subsea well and process equipment located on the deck; and (i) off loading collected well fluids to a remotely located cargo barge or pipeline.

* * * * *